US012584476B2

(12) United States Patent
Kort

(10) Patent No.: US 12,584,476 B2
(45) Date of Patent: Mar. 24, 2026

(54) METHOD FOR OPERATING A CONSTRUCTION-MATERIAL AND/OR VISCOUS-MATERIAL PUMP FOR CONVEYING CONSTRUCTION MATERIAL AND/OR VISCOUS MATERIAL, AND A CONSTRUCTION-MATERIAL AND/OR VISCOUS-MATERIAL PUMP

(71) Applicant: Putzmeister Engineering GmbH, Aichtal (DE)

(72) Inventor: Frederik Kort, Stuttgart (DE)

(73) Assignee: Putzmeister Engineering GmbH, Aichtal (DE)

( * ) Notice: Subject to any disclaimer, the term of this patent is extended or adjusted under 35 U.S.C. 154(b) by 218 days.

(21) Appl. No.: 18/281,028

(22) PCT Filed: Mar. 1, 2022

(86) PCT No.: PCT/EP2022/055070
§ 371 (c)(1),
(2) Date: Sep. 8, 2023

(87) PCT Pub. No.: WO2022/189201
PCT Pub. Date: Sep. 15, 2022

(65) Prior Publication Data

US 2024/0159227 A1 May 16, 2024

(30) Foreign Application Priority Data

Mar. 10, 2021 (DE) ..... 10 2021 202 325.8

(51) Int. Cl.
*F04B 49/20* (2006.01)
*F04B 1/26* (2006.01)
(Continued)

(52) U.S. Cl.
CPC ..... *F04B 49/20* (2013.01); *F04B 1/26* (2013.01); *F04B 15/02* (2013.01); *F04B 19/22* (2013.01);
(Continued)

(58) Field of Classification Search
CPC ..... F04B 1/02; F04B 1/06; F04B 1/34; F04B 9/08; F04B 9/10; F04B 9/109;
(Continued)

(56) References Cited

U.S. PATENT DOCUMENTS 4,074,955 A * 2/1978 Nonnemacher ..... F04B 49/007 60/488
5,580,166 A 12/1996 Schmittchen et al.
(Continued)

FOREIGN PATENT DOCUMENTS

DE 40 02 760 C2 3/1993
DE 43 25 044 C2 7/2002
(Continued)

OTHER PUBLICATIONS

International Search Report (PCT/ISA/210) issued in PCT Application No. PCT/EP2022/055070 dated May 18, 2022 with English translation (4 pages).
(Continued)

*Primary Examiner* — Essama Omgba
*Assistant Examiner* — Chirag Jariwala
(74) *Attorney, Agent, or Firm* — Crowell & Moring LLP

(57) ABSTRACT

A method for operating a construction-material and/or viscous-material pump for conveying construction material and/or viscous material has the steps of: a) determining a required value of a power or of a size of the motor system, corresponding to the power, for moving the conveying piston, b) setting, on the basis of the required value, a speed value of the motor system in such a manner that a power
(Continued)

and/or speed reserve value between an operating point, wherein the operating point is defined by the required value of the power or of the size and the speed value, and a characteristic curve of the motor system, wherein the characteristic curve is defined by maximum values of the power or of the size and speed values, wherein maximum values are different for different speed values at least in sections, is greater than or equal to a reserve limit value.

15 Claims, 4 Drawing Sheets

(51) Int. Cl.
*F04B 15/02* (2006.01)
*F04B 19/22* (2006.01)
*F04B 49/06* (2006.01)

(52) U.S. Cl.
CPC ..... *F04B 49/06* (2013.01); *F04B 2203/0209* (2013.01)

(58) Field of Classification Search
CPC ..... F04B 9/117; F04B 9/1172; F04B 15/02; F04B 23/06; F04B 49/00; F04B 49/002; F04B 49/06; F04B 49/065; F04B 49/02; F04B 49/022; F04B 49/10; F04B 49/103; F04B 49/106; F04B 49/16; F04B 49/20; F04B 1/26; F04B 19/22; F04B 2203/0209; H02P 6/06; H02P 6/10; H02P 6/17; H02P 6/28; H02P 27/08
See application file for complete search history.

(56) References Cited

U.S. PATENT DOCUMENTS

| | | | | |
|---|---|---|---|---|
| 5,702,209 | A | 12/1997 | Mauchle | |
| 2005/0025628 | A1* | 2/2005 | Jones | F04B 49/065 417/44.1 |
| 2006/0153700 | A1 | 7/2006 | Benckert et al. | |
| 2006/0182636 | A1 | 8/2006 | Ivantysynova et al. | |
| 2006/0245943 | A1 | 11/2006 | Hofmann et al. | |
| 2009/0018915 | A1 | 1/2009 | Fisse | |
| 2009/0185915 | A1 | 7/2009 | Sanger et al. | |
| 2009/0269213 | A1* | 10/2009 | Anderson | F02D 29/04 417/364 |
| 2010/0092308 | A1* | 4/2010 | Stiles, Jr. | E04H 4/1245 417/44.11 |
| 2017/0260982 | A1 | 9/2017 | Grotterud et al. | |
| 2020/0340472 | A1* | 10/2020 | Blankemeier | H02P 29/00 |
| 2022/0341197 | A1 | 10/2022 | Wiesenack et al. | |

FOREIGN PATENT DOCUMENTS

| | | | |
|---|---|---|---|
| DE | 101 50 467 | A1 | 4/2003 |
| DE | 103 07 190 | A1 | 9/2004 |
| DE | 10 2013 104 494 | A1 | 11/2014 |
| DE | 10 2013 018 606 | B4 | 7/2019 |
| DE | 10 2019 214 034 | A1 | 3/2021 |
| EP | 1 072 795 | A1 | 1/2001 |
| ES | 2 290 897 | T3 | 2/2008 |
| JP | 59-68582 | A | 4/1984 |
| JP | 8-338361 | A | 12/1996 |
| JP | 2001-207992 | A | 8/2001 |
| JP | 2002-206343 | A | 7/2002 |

OTHER PUBLICATIONS

German-language Written Opinion (PCT/ISA/237) issued in PCT Application No. PCT/EP2022/055070 dated May 18, 2022 with English translation (10 pages).
Japanese-language Office Action issued in Japanese Application No. 2023-552038 dated Sep. 9, 2025 with English translation (5 pages).

* cited by examiner

METHOD FOR OPERATING A CONSTRUCTION-MATERIAL AND/OR VISCOUS-MATERIAL PUMP FOR CONVEYING CONSTRUCTION MATERIAL AND/OR VISCOUS MATERIAL, AND A CONSTRUCTION-MATERIAL AND/OR VISCOUS-MATERIAL PUMP

FIELD OF USE AND PRIOR ART

The invention relates to a method for operating a construction-material and/or viscous-material pump for conveying construction material and/or viscous material, and to a construction-material and/or viscous-material pump for conveying construction material and/or viscous material.

PROBLEM AND SOLUTION

The problem addressed by the invention is that of providing a method for operating a construction-material and/or viscous-material pump for conveying construction material and/or viscous material, and a construction-material and/or viscous-material pump for conveying construction material and/or viscous material, which each have improved characteristics.

The invention solves the problem by providing a method and a construction-material and/or viscous-material pump having the features of the independent claims. Advantageous refinements and/or embodiments of the invention are described in the dependent claims.

The, in particular automatic, method according to the invention is provided or designed or configured to in particular automatically operate a construction-material and/or viscous-material pump for the purposes of in particular automatically conveying construction material and/or viscous material. The construction-material and/or viscous-material pump comprises or has at least one conveying cylinder, at least one conveying piston and a motor system. The conveying cylinder is designed or configured to in particular directly receive and in particular directly discharge construction material and/or viscous material. The conveying piston is arranged, and in particular designed or configured, to be movable, in particular longitudinally movable, in the conveying cylinder in order to in particular directly take in construction material and/or viscous material into the conveying cylinder and in order to in particular directly displace taken-in construction material and/or viscous material out of the conveying cylinder, in particular in order to convey construction material and/or viscous material. The motor system is designed or configured to in particular cyclically move the conveying piston, in particular for the purposes of taking-in and displacement.

The method comprises or has the steps: a) ascertaining, in particular automatically ascertaining and/or detecting, an in particular present or current required value of a power, in particular of a motor power, or of an in particular physical variable of the motor system that corresponds to the power, for moving the conveying piston, and, b) depending on the in particular ascertained required value, setting or adapting, in particular automatically setting, a rotational speed value, in particular a motor rotational speed value, of the motor system such that a power and/or rotational speed reserve value between an in particular present or current operating point, in particular a motor operating point, and a characteristic curve, in particular a motor characteristic curve, of the motor system is equal to or greater than a reserve limit value. The operating point is defined by the in particular ascertained required value of the power or of the variable and the in particular set rotational speed value. The characteristic curve is defined by maximum values of the power or of the variable and in particular assigned or associated rotational speed values. Maximum values, in particular of the power or of the variable, differ at least in part, in particular entirely, for different rotational speed values.

This, in particular the demand-based setting of the rotational speed value or the setting of the rotational speed value such that the power and/or rotational speed reserve value is equal to or greater than the reserve limit value, makes it possible to avoid overloading of the motor system and/or in particular therefore a drop in the rotational speed value, in particular when construction material and/or viscous material is being conveyed. This allows construction material and/or viscous material to be conveyed with little or no diminishment, in particular with a scarcely changed or unchanged conveying volume flow.

In particular, the motor system may be inert, in particular may have an inert mass. This can therefore, in particular if a rotational speed value is not set in accordance with the invention, lead to overloading of the motor system and thus a drop in the rotational speed value. This can result in construction material and/or viscous material being conveyed in a diminished manner, in particular with a reduced conveying volume flow.

The motor system may have, in particular be, a combustion and/or electric motor system.

The construction-material and/or viscous-material pump may be a mobile construction-material and/or viscous-material pump, in particular a truck-mounted construction-material and/or viscous-material pump.

Construction material may refer to mortar, cement, screed, concrete and/or plaster. Additionally or alternatively, viscous material may refer to sludge.

The required value, the rotational speed value and/or the power and/or rotational speed reserve value may in particular each be changeable or variable in stepless, in particular continuous, fashion. Additionally or alternatively, the rotational speed value may be different or changed or set for a different or changed required value.

Setting of the rotational speed value, in a manner dependent on the required value, such that the power and/or rotational speed reserve value is equal to or greater than the reserve limit value may include, in particular be, open-loop or closed-loop control of the power and/or rotational speed reserve value and/or of the operating point with the rotational speed value as manipulated variable or controlled variable.

The setting of the rotational speed value may be such that the power and/or rotational speed reserve value does not need to be, or may not be, less than the reserve limit value.

The reserve limit value may be greater than zero. Additionally or alternatively, the reserve limit value may be predetermined or predefined, in particular by a user or an operator and/or in a manner dependent on an operating mode of the construction-material and/or viscous-material pump and/or in a manner dependent on present or current rotational speed value, in particular of the motor system. In particular, the reserve limit value may differ for different operating modes of the construction-material and/or viscous-material pump. For example, the reserve limit value may be low if in particular only one boom, in particular one distributor boom, of the construction-material and/or viscous-material pump is being operated and therefore in particular no large power fluctuations are to be expected. Additionally or alternatively, the reserve limit value may differ for a different present rotational speed value. Further additionally or alternatively, "limit value" may be referred to as "target value". Further additionally or alternatively, the reserve limit value may be a power and/or rotational speed reserve limit value.

"Maximum value" may be referred to as "maximum available value" or "nominal value".

The operating point may be or lie under and/or to the right of the characteristic curve.

"At least in part" may mean at least 20% (percent), in particular at least 30%, in particular at least 40%, in particular at least 50%.

The method, in particular step a), may include or comprise: ascertaining, in particular automatically ascertaining and/or detecting, an in particular present or current required torque value of a torque, in particular of a motor torque, or an in particular physical variable of the motor system that corresponds to the torque, in particular for moving the conveying piston. Additionally or alternatively, the method, in particular step b), may include or comprise: depending on the in particular ascertained required torque value, setting the rotational speed value such that a torque reserve value between an in particular present or current torque operating point, in particular a motor torque operating point, and a torque characteristic curve, in particular a motor torque characteristic curve, of the motor system is equal to or greater than a torque reserve value. The torque operating point is defined by the in particular ascertained required torque value of the torque or of the variable and the in particular set rotational speed value. The characteristic curve is defined by maximum values of the torque or of the variable and in particular assigned or associated rotational speed values. Maximum values, in particular of the torque or of the variable, differ at least in part, in particular entirely, for different rotational speed values. This makes it possible to avoid overloading of the motor system. In particular, the motor system they have a power takeoff and/or a transmission. Additionally or alternatively, the torque reserve value may be changeable or variable in stepless, in particular continuous fashion. Further additionally or alternatively, the rotational speed value may be different or changed or set for a different or changed required torque value. Further additionally or alternatively, setting of the rotational speed value, in a manner dependent on the required torque value, such that the torque reserve value is equal to or greater than the torque reserve limit value may include, in particular be, open-loop or closed-loop control of the torque reserve value and/or of the torque operating point with the rotational speed value as manipulated variable or controlled variable. Further additionally or alternatively, the setting of the rotational speed value may be such that the torque reserve value does not need to be, or may not be, less than the reserve limit value. Further additionally or alternatively, the torque reserve limit value may be greater than zero. Further additionally or alternatively, the torque reserve limit value may be predetermined or predefined. Further additionally or alternatively, the torque operating point may be or lie under and/or to the right of the torque characteristic curve.

In one refinement of the invention, the maximum values increase at least in part, in particular entirely, for increasing rotational speed values. Thus, the rotational speed value can be increased or set for an increased required value and the rotational speed value can be lowered or set for a required value.

In one refinement of the invention, step b) comprises or includes: setting the rotational speed value such that the power and/or rotational speed reserve value is equal to or less than a further reserve limit value. The further reserve limit value is greater than or equal to the reserve limit value. This allows an optimum rotational speed value, in particular a rotational speed value which is optimum in terms of efficiency, or optimum operation of the motor system, in particular operation of the motor system which is efficient in terms of energy consumption and/or optimum in terms of wear and/or optimum in terms of noise emissions. In particular, the further reserve limit value may be predetermined or predefined, in particular by the user and/or in a manner dependent on the operating mode of the construction-material and/or viscous-material pump. In particular, the further reserve limit value may differ for different operating modes of the construction-material and/or viscous-material pump. Additionally or alternatively, the further reserve limit value may be predetermined or be defined, in particular in a manner dependent on a, in particular the, present or current rotational speed value, in particular of the motor system. In particular, the further reserve limit value may differ for a different present rotational speed value.

In particular, the power and/or rotational speed reserve value, in particular the power reserve value, may correspond to, in particular be equal to: (maximum value at the in particular set rotational speed value−required value). Additionally or alternatively, the power and/or rotational speed reserve value, in particular the rotational speed reserve value, may correspond to, in particular be equal to: (set rotational speed value−rotational speed value for a maximum value equal to the required value).

In one refinement, in particular one embodiment, of the invention, the power and/or rotational speed reserve value corresponds to, in particular is equal to: (maximum value at the in particular set rotational speed value−required value)/maximum value at the in particular set rotational speed value, and/or (set rotational speed value−rotational speed value for a maximum value equal to the required value)/set rotational speed value. In particular, the reserve limit value corresponds to, in particular is equal to or is, at least 2%, in particular at least 5%, in particular at least 10%. Additionally or alternatively, the further reserve limit value, if present, corresponds to, in particular is equal to or is, at most 40%, in particular at most 30%, in particular at most 20%.

In one refinement, in particular in one embodiment, of the invention, the method has the step: ascertaining, in particular automatically ascertaining, a, in particular the, present or current maximum value at a, in particular the, present or current rotational speed value, in particular of the motor system. Step b) comprises or includes: ascertaining, in particular automatically ascertaining and/or calculating, a present or current comparison variable value, in particular a, in particular the, present or current power and/or rotational speed reserve value, on the basis of the in particular ascertained present maximum value and the in particular ascertained required value. Comparing, in particular automatically comparing, the in particular ascertained present comparison variable value with a comparison variable limit value at least associated with the reserve limit value, and in particular a further comparison variable limit value at least associated with the further reserve limit value, if present. Setting the rotational speed value in a manner dependent on, in particular a result of, the comparison. This makes it possible for the power and/or rotational speed reserve value to be able to be, in particular to be, greater than or equal to the reserve limit value, and in particular equal to or less than the further reserve limit value.

In one refinement, in particular one embodiment, of the invention, the construction-material and/or viscous-material pump comprises or has an in particular electrical control device. The control device is distinct, in particular entirely distinct, from the motor system. The method comprises or includes: ascertaining the required value, and in particular the comparison variable value, if present, and/or setting the rotational speed value by means of the motor system. The method comprises or includes: ascertaining, in particular automatically ascertaining and/or calculating, a setting command, in particular a value of the setting command, in particular comparing the comparison variable value with the comparison variable limit value, if present, in order to set the rotational speed value by means of the control device. This allows an advantageous distribution of functions and/or tasks and/or in particular therefore an advantageous structural design of the construction-material and/or viscous-material pump. In particular, the motor system and/or the control device may in particular each have a processor and/or a memory.

In one refinement of the invention, step a) comprises or includes: Ascertaining, in particular automatically ascertaining and/or calculating, the required value on the basis of at least one part variable, in particular a value of the part variable, of a part of the construction-material and/or viscous-material pump. The part is distinct, in particular entirely distinct, from the motor system. This allows the required value to be ascertained if it cannot be possible, in particular is not possible, for the required value to be ascertained by means of the motor system, or if the required value cannot be provided, in particular is not provided, by means of the motor system. In particular, the method may have the step: ascertaining, in particular automatically ascertaining and/or detecting, the part variable.

In one embodiment of the invention, the construction-material and/or viscous-material pump comprises or has a hydraulic drive system. The motor system is designed or configured to move the hydraulic drive system. The hydraulic drive system, in particular at least one drive piston, and in particular at least one piston rod, of the hydraulic drive system is designed or configured to move the conveying piston, in particular for the purposes of taking-in and displacement. The part variable is a drive variable of the hydraulic drive system. Additionally or alternatively, the part variable is a conveying variable of the conveying piston. Further additionally or alternatively, the construction-material and/or viscous-material pump comprises or has an adjustable line switch system. The part variable is a switch variable of the line switch system. Such a part variable enables the required value to be ascertained. In particular, the hydraulic drive system may have at least one drive cylinder. The drive cylinder may be designed to in particular directly receive hydraulic liquid, in particular hydraulic oil. The drive piston may be arranged movably, in particular longitudinally movably, in the drive cylinder. Additionally or alternatively, the piston rod may be fastened to the drive piston, and in particular to the conveying piston, for in particular direct movement coupling with, or transmission of movement to, the conveying piston. Further additionally or alternatively, the line switch system may be referred to as a gate valve system. Further additionally or alternatively, the line switch system may have a pipe switch, in particular an S-shaped pipe. Further additionally or alternatively, the construction-material and/or viscous-material pump may have a conveying line and a construction-material and/or viscous-material supply, in particular a supply hopper. The line switch system may be designed to connect the conveying cylinder in particular either to the conveying line in one position, or the construction-material and/or viscous-material supply in another position, for a flow or current of construction material and/or viscous material.

In one embodiment of the invention, the drive variable and/or the conveying variable are/is in particular in each case a stroke or cycle duration, in particular of a stroke movement or of a movement stroke or cycle, and/or a speed of the drive piston, of the piston rod and/or of the conveying piston. Additionally or alternatively, the drive variable is a drive volume flow. Further additionally or alternatively, the conveying variable is a conveying volume flow, in particular of construction material and/or viscous material. Further additionally or alternatively, the drive variable is a drive pressure, in particular of hydraulic liquid. Further additionally or alternatively, the conveying variable is a conveying pressure, in particular of construction material and/or viscous material. In particular, the drive pressure and/or the conveying pressure prevail(s), in particular spontaneously and/or in each case, when construction material and/or viscous material is being conveyed. Further additionally or alternatively, the switch variable is an adjustment duration, in particular of an adjustment, of the line switch system. In particular, the stroke duration and/or the speed and/or the adjustment duration may in particular in each case be detected by means of a timing device and/or a position detection device, in particular a position measuring system. Additionally or alternatively, the conveying volume flow may be predefined by the user. Further additionally or alternatively, the drive volume flow may be ascertained on the basis of the conveying volume flow. Further additionally or alternatively, the drive pressure and/or the conveying pressure may in particular each be detected by means of a pressure detection device. Further additionally or alternatively, the drive pressure may in particular spontaneously prevail in a manner dependent on the conveying pressure when construction material and/or viscous material is being conveyed. Further additionally or alternatively, the drive pressure may be a drive high pressure.

In one refinement of the invention, the required value is an in particular presently or currently demanded or output or actual power, or a variable of the motor system that corresponds to the demanded power, for moving the conveying piston.

In one refinement of the invention, the method comprises or includes: ascertaining, in particular automatically ascertaining, the characteristic curve by interpolation based on in particular predefined interpolation points. The interpolation points are defined by in particular predefined maximum values and in particular predefined rotational speed values. This allows the characteristic curve to be ascertained if the characteristic curve cannot be, in particular is not, entirely known.

In one refinement of the invention, steps a) and b) are repeated, in particular multiple times and/or automatically, in particular during a, in particular the, stroke movement or a movement stroke or cycle of the conveying piston in the conveying cylinder. This makes it possible to particularly effectively avoid overloading of the motor system and/or in particular therefore a drop in the rotational speed value.

In one refinement of the invention, step a) comprises or includes: ascertaining the required value for at least one position, in particular a middle position, of the conveying piston along its stroke in the conveying cylinder between its end positions, in particular remote from the end positions. This means that the required value can be of a representative nature. Additionally or alternatively, this makes it possible to avoid overloading of the motor system and/or in particular therefore a drop in the rotational speed value at in particular each of the end positions. In particular, upon a change in direction of the movement, or a change in a movement direction, of the conveying piston at in particular each of the end positions, or at a start and/or an end of a, in particular the, stroke movement of the conveying piston, the required value may be increased, or may have a peak, in particular a power peak, in particular in relation to a middle or the middle position. Since the motor system may be inert, in particular may have an inert mass, an in particular non-inventive reaction, in particular setting of the rotational speed value, only at the end positions may be too late. This can therefore, particular in the case of a rotational speed value being non-inventively ascertained in a manner dependent on the required value and set for the position between the end positions, lead to overloading of the motor system and/or in particular therefore to a drop in the rotational speed value at in particular each of the end positions. In particular, "remote from the end positions" can mean closer to the middle position than to the end positions. Additionally or alternatively, the at least one position or an in particular physical variable that corresponds to the position may be detected by means of a position detection device, in particular a position measuring system.

In one refinement of the invention, the construction-material and/or viscous-material pump comprises or has a, in particular the, hydraulic drive system. The hydraulic drive system comprises or has an axial piston pump with variably adjustable swashplate or slide plate. The motor system is designed or configured to rotate the axial piston pump. The axial piston pump is designed or configured to move the conveying piston, in particular for the purposes of taking-in and displacement. This, in particular the demand-based setting of the rotational speed value or the setting of the rotational speed value such that the power and/or rotational speed reserve value is equal to or greater than the reserve limit value, makes it possible to avoid an adjustment or a reduction of a pivot angle of the swashplate, and in particular therefore diminished conveyance of construction material and/or viscous material. In particular, the axial piston pump may be designed to generate a drive volume flow or stream of hydraulic liquid, in particular with a drive pressure, for moving in particular the drive piston and therefore the conveying piston.

The construction-material and/or viscous-material pump according to the invention is designed or configured to convey construction material and/or viscous material. The construction-material and/or viscous-material pump has at least one, in particular the, conveying cylinder, at least one, in particular the, conveying piston and a, in particular the, motor system. The conveying cylinder is configured to receive and discharge construction material and/or viscous material. The conveying piston is arranged movably in the conveying cylinder in order to take in construction material and/or viscous material into the conveying cylinder and in order to displace taken-in construction material and/or viscous material out of the conveying cylinder. The motor system is designed to move the conveying piston. The construction-material and/or viscous-material pump is designed to ascertain a, in particular the, required value of a, in particular the, power or of a, in particular the, variable of the motor system that corresponds to the power, for moving the conveying piston. The construction-material and/or viscous-material pump is designed to set a, in particular the, rotational speed value of the motor system in a manner dependent on the required value such that a, in particular the, power and/or rotational speed reserve value between a, in particular the, operating point and a, in particular the, characteristic curve of the motor system is equal to or greater than a, in particular the, reserve limit value. The operating point is defined by the required value of the power or of the variable and the rotational speed value. The characteristic curve is defined by maximum values of the power or of the variable and rotational speed values. Maximum values differ at least in part for different rotational speed values.

The construction-material and/or viscous-material pump may make the same advantages possible as the abovementioned or above-described method.

In particular, the construction-material and/or viscous-material pump may be designed to carry out the abovementioned method and/or be designed at least in part or entirely as stated above for the method.

Further advantages and aspects of the invention will emerge from the claims and from the description of exemplary embodiments of the invention, which are discussed below on the basis of the figures.

DETAILED DESCRIPTION OF THE EXEMPLARY EMBODIMENTS

Figure 1:
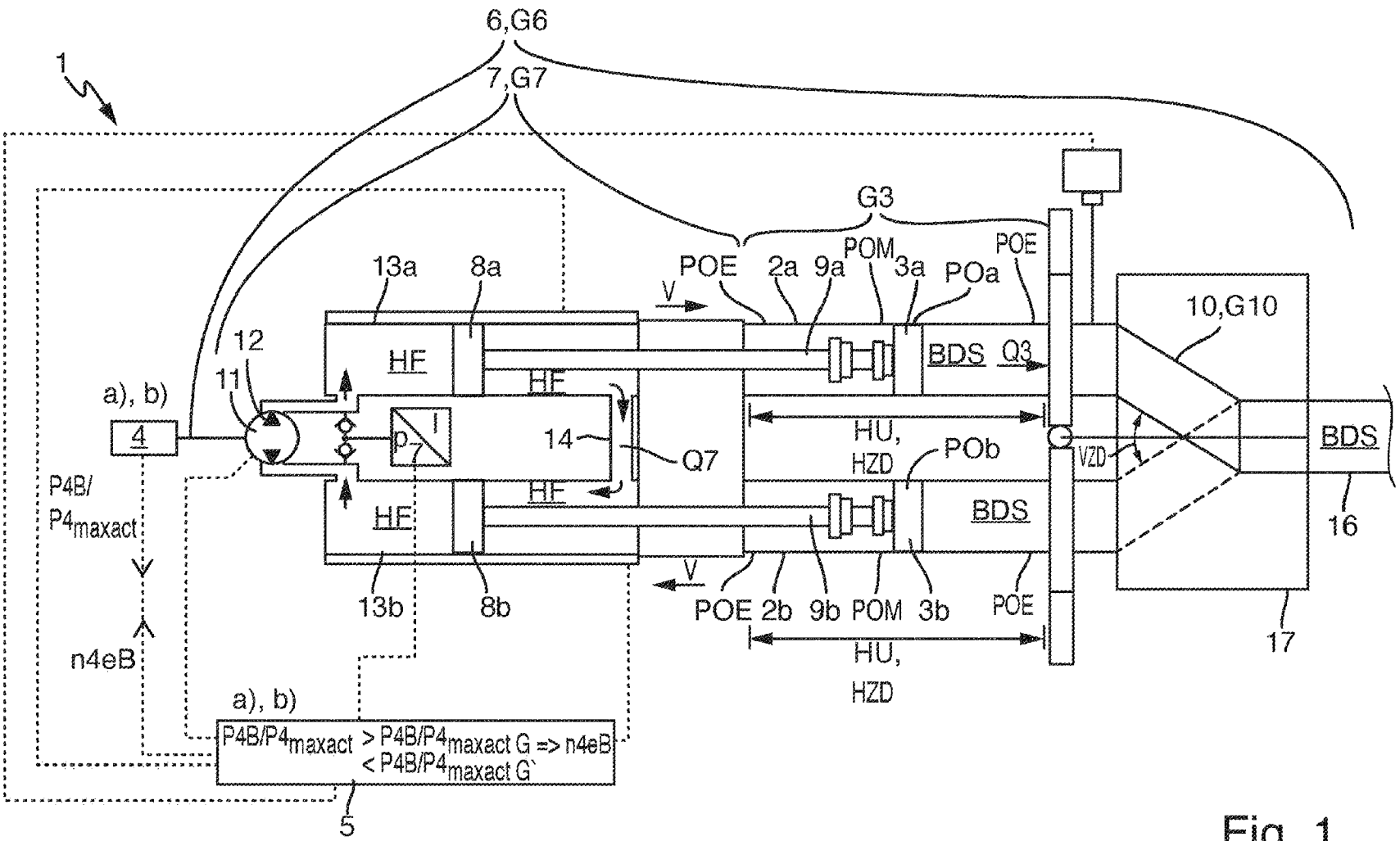
FIG. 1 is a schematic diagram of a construction-material and/or viscous-material pump according to the invention for conveying construction material and/or viscous material by way of a method according to the invention for operating the construction-material and/or viscous-material pump.

FIG. 1 shows a construction-material and/or viscous-material pump 1 for conveying construction material and/or viscous material BDS.

FIGS. 1 to 4 show a method for operating the construction-material and/or viscous-material pump 1 for conveying construction material and/or viscous material BDS.

Figure 3:
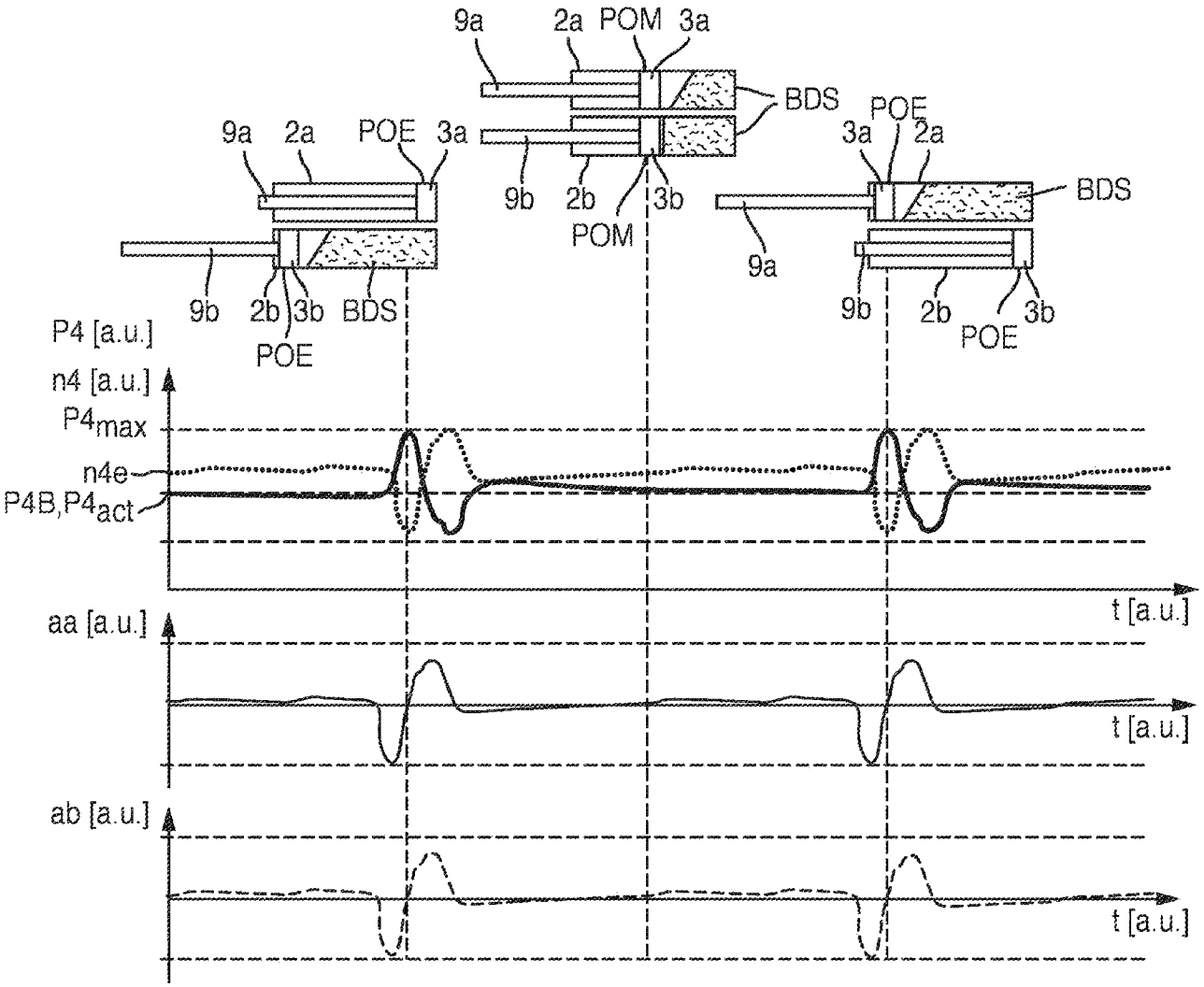
FIG. 3 is a schematic view of a movement of a conveying piston in a conveying cylinder of the construction-material and/or viscous-material pump for conveying construction material and/or viscous material, a graph of a required value of the power of the motor system of the construction-material and/or viscous-material pump of FIG. 1 versus the time, a graph of the rotational speed of the motor system versus the time, and a graph of an acceleration of accelerated masses of the construction-material and/or viscous-material pump, in particular of a hydraulic drive system of the construction-material and/or viscous-material pump, for example hydraulic liquid, of a drive piston, of a piston rod, of a conveying piston and/or construction material and/or viscous material, versus the time.

The construction-material and/or viscous-material pump 1 has at least one conveying cylinder 2*a*, 2*b*, at least one conveying piston 3*a*, 3*b* and a motor system 4. The conveying cylinder 2*a*, 2*b* is configured to receive and discharge, in particular receives and discharges, construction material and/or viscous material BDS, as shown in FIG. 3. The conveying piston 3*a*, 3*b* is arranged movably in the conveying cylinder 2*a*, 2*b* in order to take in construction material and/or viscous material BDS into the conveying cylinder 2*a*, 2*b* and in order to displace taken-in construction material and/or viscous material BDS out of the conveying cylinder 2*a*, 2*b*, in particular moves in the conveying cylinder 2*a*, 2*b* and takes in construction material and/or viscous material BDS into the conveying cylinder 2*a*, 2*b* and displaces taken-in construction material and/or viscous material BDS out of the conveying cylinder 2*a*, 2*b*. The motor system 4 is designed to move, in particular moves, the conveying piston 3*a*, 3*b*.

Figure 2:
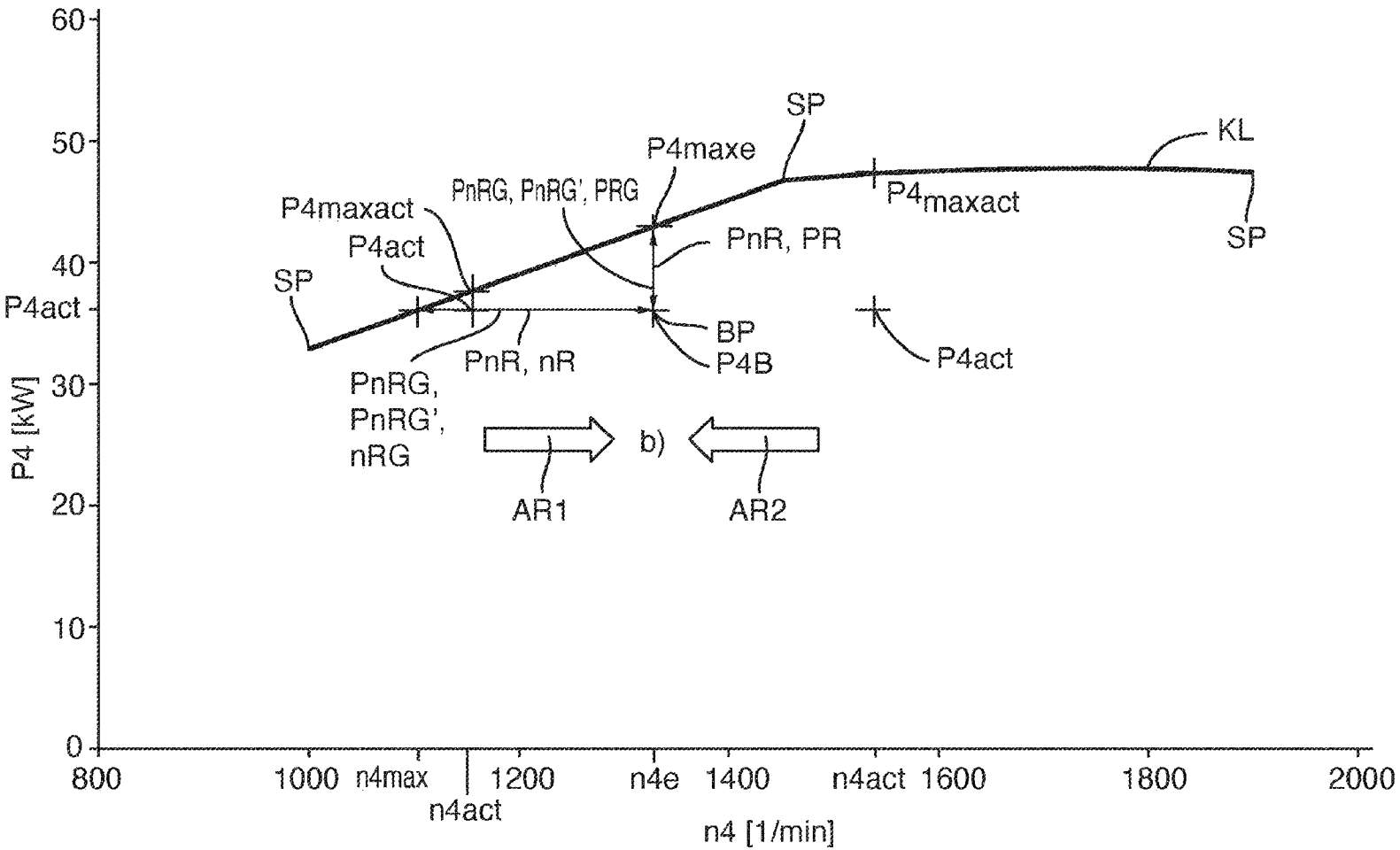
FIG. 2 is a graph of a power of a motor system of the construction-material and/or viscous-material pump of FIG. 1 versus a rotational speed of the motor system.

The construction-material and/or viscous-material pump 1 is designed to ascertain, in particular ascertains, a required value P4B of a power P4, or of a variable of the motor system 4 that corresponds to the power, for moving the conveying piston 3*a*, 3*b*, as shown in FIG. 2. The construction-material and/or viscous-material pump 1 is designed to set, in particular sets, a rotational speed value n4*e* of the motor system 4 in a manner dependent on the required value P4B such that a power and/or rotational speed reserve value PnR between an operating point BP and a characteristic curve KL of the motor system 4 is equal to or greater than a reserve limit value PnRG.

The method has the steps: a) ascertaining the required value P4B of the power P4, or of the variable of the motor system 4 that corresponds to the power, for moving the conveying piston 3*a*, 3*b*, and, b) depending on the required value P4B, setting the rotational speed value n4*e* of the motor system 4 such that the power and/or rotational speed reserve value PnR between the operating point BP and the characteristic curve KL of the motor system 4 is equal to or greater than the reserve limit value PnRG.

The operating point BP is defined by the required value P4B of the power P4 or of the variable and the rotational speed value n4*e*. The characteristic curve KL is defined by maximum values P4max of the power P4 or of the variable and rotational speed values n4. Maximum values P4max differ at least in part for different rotational speed values n4.

In detail, the maximum values P4max increase at least in part for increasing rotational speed values n4.

Step b) furthermore includes: setting the rotational speed value n4*e* such that the power and/or rotational speed reserve value PnR is equal to or less than a further reserve limit value PnRG'. The further reserve limit value PnRG' is greater than or equal to the reserve limit value PnRG.

Furthermore, the power and/or rotational speed reserve value PnR corresponds to: (maximum value P4maxe at the rotational speed value n4*e*–required value P4B)/maximum value P4maxe at the rotational speed value n4*e*, as shown in FIG. 2.

Additionally or alternatively, the power and/or rotational speed reserve value PnR corresponds to: (set rotational speed value n4*e*-rotational speed value n4max for a maximum value P4max equal to the required value P4B)/set rotational speed value n4*e*.

In particular, the reserve limit value PnRG corresponds to at least 2%, in particular at least 5%, in particular at least 10%.

Additionally or alternatively, the further reserve limit value PnRG' corresponds to at most 40%, in particular at most 30%, in particular at most 20%.

Figure 4:
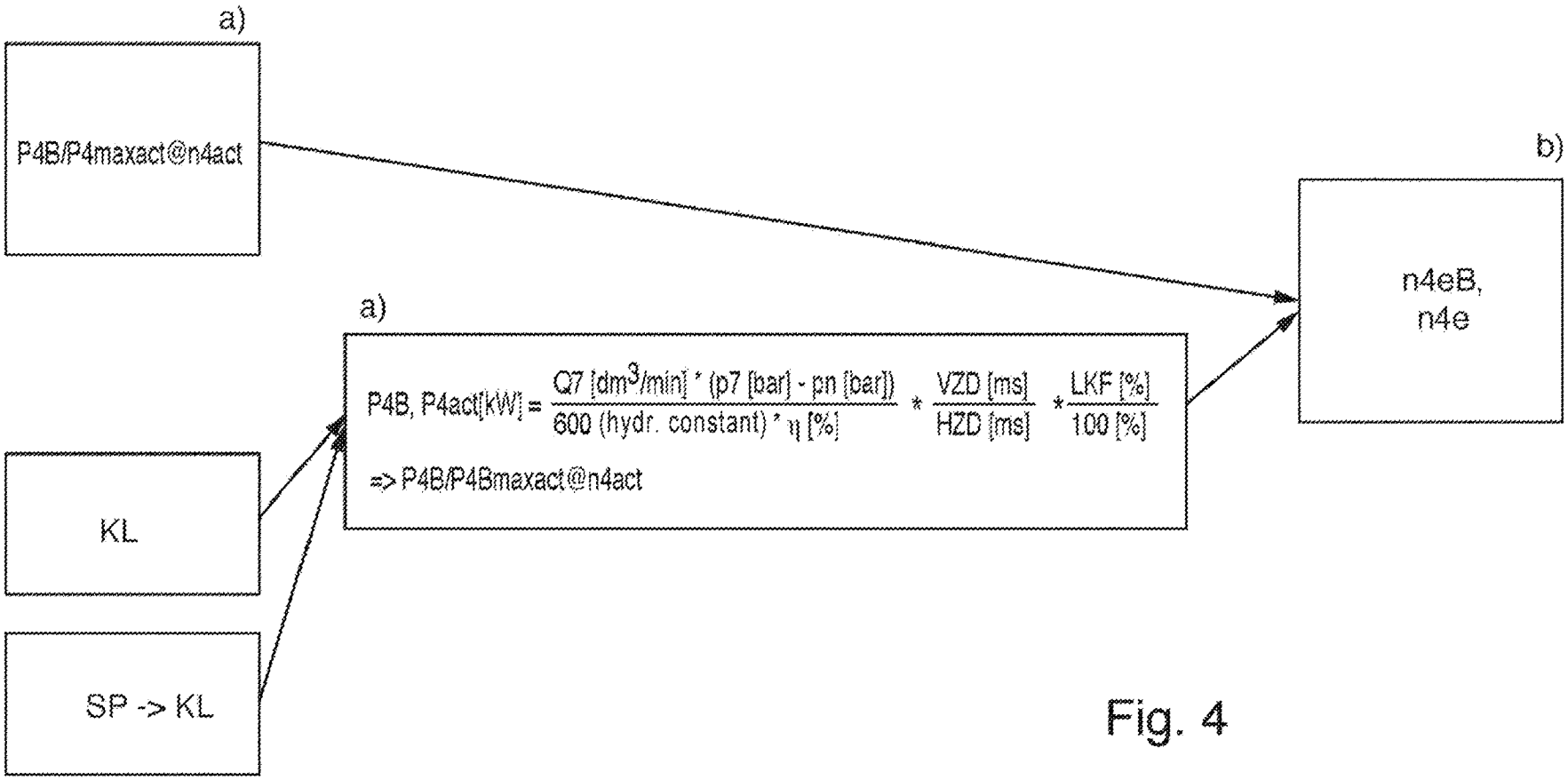
FIG. 4 is a flow diagram of the method of FIG. 1.

The method furthermore has the step: ascertaining a present maximum value P4maxact at a present rotational speed value n4act, as shown in FIGS. 1, 2 and 4. Step b) includes: ascertaining a present comparison variable value P4B/P4maxact, in particular a present power and/or rotational speed reserve value, on the basis of the present maximum value P4maxact and the required value P4B. Comparing the present comparison variable value P4B/P4maxact with a comparison variable limit value P4B/P4maxactG at least associated with the reserve limit value PnRG, and in particular a further comparison variable limit value P4B/P4maxactG' at least associated with the further reserve limit value PnRG'. Setting the rotational speed value n4*e* in a manner dependent on the comparison.

In the event that, or if, the present comparison variable value P4B/P4maxact is greater than the comparison variable limit value P4B/P4maxactG, the rotational speed value n4*e* is increased, in particular set, as shown in FIG. 2 by an arrow AR1 pointing to the right. This makes it possible for the power and/or rotational speed reserve value PnR to be equal to or greater than the reserve limit value PnRG.

In the event that, or if, the present comparison variable value P4B/P4maxact is less than the further comparison variable limit value P4B/P4maxactG', the rotational speed value n4*e* is lowered, in particular set, as shown in FIG. 2 by an arrow AR2 pointing to the left. This makes it possible for the power and/or rotational speed reserve value PnR to be equal to or less than the further reserve limit value PnRG'.

The construction-material and/or viscous-material pump 1 furthermore has a control device 5, as shown in FIG. 1. The control device 5 is distinct from the motor system 4. The method includes: ascertaining the required value P4B, and in particular the comparison variable value P4B/P4maxact, and/or setting the rotational speed value n4*e* by means of the motor system 4. The method includes: ascertaining a setting command n4*e*B, in particular comparing the comparison variable value P4B/P4maxact with the comparison variable limit value P4B/P4maxactG, in order to set the rotational speed value n4*e* by means of the control device 5.

At the top in FIG. 4, the required value P4B, and in particular the comparison variable value P4B/P4maxact, is ascertained by means of the motor system 4.

Additionally or alternatively, in particular in the middle and at the bottom in FIG. 4, step a) includes: ascertaining, in particular calculating as shown by a formula at the bottom in FIG. 4, the required value P4B on the basis of at least one part variable G6 of a part 6 of the construction-material and/or viscous-material pump 1, in particular by means of the control device 5. The part 6 is distinct from the motor system 4.

In detail, the construction-material and/or viscous-material pump 1 has a hydraulic drive system 7.

The motor system 4 is designed to move, in particular moves, the hydraulic drive system 7. The hydraulic drive system 7, in particular at least one drive piston 8*a*, 8*b* and in particular at least one piston rod 9*a*, 9*b* of the hydraulic drive system 7, is designed to move, in particular moves, the conveying piston 3*a*, 3*b*. The part variable G6 is a drive variable G7 of the hydraulic drive system 7.

Additionally or alternatively, the part variable G6 is a conveying variable G3 of the conveying piston 3*a*, 3*b*.

Further additionally or alternatively, the construction-material and/or viscous-material pump has an adjustable line switch system 10. The part variable G6 is a switch variable G10 of the line switch system 10.

In particular, the drive variable G7 and/or the conveying variable G3 are/is a stroke duration HZD and/or a speed v of the drive piston 8*a*, 8*b*, of the piston rod 9*a*, 9*b* and/or of the conveying piston 3*a*, 3*b*.

Additionally or alternatively, the drive variable G7 is a drive volume flow Q7.

Further additionally or alternatively, the conveying variable G3 is a conveying volume flow Q3.

Further additionally or alternatively, the drive variable G7 is a drive pressure p'7, in particular a drive high pressure. Further additionally or alternatively, the conveying variable is a conveying pressure. In particular, the drive pressure p7 and/or the conveying pressure prevail(s), in particular spontaneously and/or in each case, when construction material and/or viscous material BDS is being conveyed.

Further additionally or alternatively, the switch variable G10 is an adjustment duration VZD of the line switch system 10.

Furthermore, in the formula shown in FIG. 4, pn is a drive low pressure, q is an overall efficiency, in particular of at least one drive pump as far as the motor system 4, and LKF is a power correction factor.

In alternative exemplary embodiments, the formula does not need to, or may not, include or utilize the adjustment duration, the stroke duration and/or the power correction factor, or the two final terms/fractions.

Furthermore, in the exemplary embodiment shown, the required value P4B is a demanded power P4act, or a variable of the motor system 4 that corresponds to the demanded power, for moving the conveying piston 3*a*, 3*b*.

Furthermore, in particular at the bottom in FIG. 4, the method includes: ascertaining the characteristic curve KL by interpolation on the basis of interpolation points SP, as shown in FIG. 2. The interpolation points SP are defined by maximum values P4max and rotational speed values n4.

Furthermore, the steps a) and b) are repeated, in particular multiple times, in particular during a stroke movement of the conveying piston 3*a*, 3*b* in the conveying cylinder 2*a*, 2*b*.

Step a) furthermore includes: ascertaining the required value P4B for at least one position POa, POb, in particular a middle position POM, of the conveying piston 3*a*, 3*b* along its stroke HU in the conveying cylinder 2*a*, 2*b* between its end positions POE, in particular remote from the end positions POE.

In particular, upon a change in direction of the movement of the conveying piston 3*a*, 3*b* at the end positions POE, the required value P4B is increased, or has a peak, in particular in relation to the middle position POM, as shown in FIG. 3.

This, in particular the setting of the rotational speed value n4*e* in a manner dependent on the required value P4B, in particular ascertained for the position POa, POb between the end positions POE, such that the power and/or rotational speed reserve value PnR is equal to or greater than the reserve limit value PnRG, makes it possible to avoid overloading of the motor system 4 and/or in particular therefore a drop in the rotational speed value n4, which in particular diminish the conveyance of construction material and/or viscous material BDS, in particular at the end positions POE. In other words, at the end positions POE, the in particular increased required value P4B can thus be precisely covered.

In detail, the hydraulic drive system 7, in particular in the form of a drive pump, has an axial piston pump 11 with variably adjustable swashplate 12. The motor system 4 is designed to rotate, in particular rotates, the axial piston pump 11. The axial piston pump 11 is designed to move, in particular moves, the conveying piston 3*a*, 3*b*.

In the exemplary embodiment shown, the construction-material and/or viscous-material pump 1, in particular the hydraulic drive system 7, has exactly two conveying cylinders 2*a*, 2*b*, exactly two conveying pistons 3*a*, 3*b*, exactly two drive pistons 8*a*, 8*b*, exactly two drive cylinders 13*a*, 13*b* for receiving hydraulic liquid HF and in which the drive pistons 8*a*, 8*b* are movably arranged, and/or exactly two piston rods 9*a*, 9*b*. In alternative exemplary embodiments, the construction-material and/or viscous-material pump, in particular the hydraulic drive system, may have only a single conveying cylinder, only a single conveying piston, only a single drive piston, only a single drive cylinder and/or only a single piston rod, or at least three conveying cylinders, at least three conveying pistons, at least three drive pistons, at least three drive cylinders and/or at least three piston rods.

In particular, in the exemplary embodiment shown, the construction-material and/or viscous-material pump 1, in particular the hydraulic drive system 7, has an oscillation line 14, in particular for hydraulic liquid HF.

The axial piston pump 11 and the two drive cylinders 13*a*, 13*b* form, via the oscillation line 14, an in particular closed drive circuit for hydraulic liquid HF. In other words: the drive cylinders 13*a*, 13*b* are connected by means of the oscillation line 14 for a flow or current of hydraulic liquid HF, in particular between the drive cylinders 13*a*, 13*b*.

Furthermore, by means of the oscillation line 14, the drive pistons 8*a*, 8*b* and therefore in particular the piston rods 9*a*, 9*b* and therefore the conveying pistons 3*a*, 3*b* are coupled to one another at least temporarily, in particular continuously over time, in particular in antiphase, in particular in 180-degree antiphase, or for opposite movement.

Furthermore, the axial piston pump 11 or the drive circuit has a high-pressure side and a low-pressure side, which are in particular cyclically interchanged, in particular during the operation of the construction-material and/or viscous-material pump 1. The construction-material and/or viscous-material pump 1 furthermore has a conveying line 16 and a construction-material and/or viscous-material supply 17. The line switch system 10 is configured to connect, in particular connects, the conveying cylinder 2*a*, 2*b* in particular either to the conveying line 16, in one position, or to the construction-material and/or viscous-material supply 17, in another position, for a flow or stream of construction material and/or viscous material BDS.

In FIG. 1, the line switch system 10 connects the conveying cylinder 2*a* to the conveying line 16 and connects the conveying cylinder 2*b* to the construction-material and/or viscous-material supply 17.

Furthermore, the conveying piston 3*b* takes in construction material and/or viscous material BDS into the conveying cylinder 2*b*, in particular from the in particular connected construction-material and/or viscous-material supply 17. The conveying piston 3*a*, in particular at the same time, displaces taken-in construction material and/or viscous material BDS out of the conveying cylinder 2*a*, in particular into the in particular connected conveying line 16.

In the event that, or when, the conveying pistons 3*a*, 3*b* have reached their in particular respective end positions POE, the line switch system 10 is adjusted, in particular by means of the control device 5. The line switch 10 thus connects the conveying cylinder 2*b* to the conveying line 16 and connects the conveying cylinder 2*a* to the construction-material and/or viscous-material supply 17. The conveying piston 3*a* thus takes in construction material and/or viscous material BDS into the conveying cylinder 2*a*, in particular from the in particular connected construction-material and/or viscous-material supply 17. The conveying piston 3*b*, in particular at the same time, displaces taken-in construction material and/or viscous material BDS out of the conveying cylinder 2*b*, in particular into the in particular connected conveying line 16.

The control device 5 furthermore has an in particular electrical signal connection inter alia to, in particular to each of, the motor system 4, the axial piston pump 11 and/or the line switch system 10, as shown by dotted lines in FIG. 1.

As is made clear by the exemplary embodiments presented and discussed above, the invention provides an advantageous method for operating a construction-material and/or viscous-material pump for conveying construction material and/or viscous material, and an advantageous construction-material and/or viscous-material pump for conveying construction material and/or viscous material, which each have improved characteristics.

What is claimed is:

1. A method for operating a construction-material and/or viscous-material pump for conveying construction material and/or viscous material, wherein the construction-material and/or viscous-material pump has:

at least one conveying cylinder, the conveying cylinder being designed to receive and discharge the construction material and/or viscous material, at least one conveying piston, the conveying piston being arranged movably in the conveying cylinder in order to take in the construction material and/or viscous material into the conveying cylinder and in order to displace the taken-in construction material and/or viscous material out of the conveying cylinder, and a motor system designed to move the conveying piston, the method comprising the steps of:

a) ascertaining a required value (P4B) of a power (P4), or of a variable of the motor system that corresponds to the power, for moving the conveying piston; and b) depending on the required value (P4B), setting a rotational speed value (n4*e*) of the motor system such that a power and/or rotational speed reserve value (PnR) between an operating point (BP) and a characteristic curve (KL) of the motor system is equal to or greater than a reserve limit value (PnRG), wherein the operating point (BP) is defined by the required value (P4B) of the power (P4) or of the variable and the rotational speed value (n4*e*), the characteristic curve (KL) is defined by maximum values (P4max) of the power (P4) or of the variable and rotational speed values (n4), wherein the maximum values (P4max) differ at least in part for different rotational speed values.

2. The method as claimed in claim 1, wherein the maximum values (P4max) increase at least in part for increasing the rotational speed values (n4).

3. The method as claimed in claim 1, wherein step b) comprises: setting the rotational speed value (n4*e*) such that the power and/or rotational speed reserve value (PnR) is equal to or less than a further reserve limit value (PnRG'), wherein the further reserve limit value (PnRG') is greater than or equal to the reserve limit value (PnRG).

4. The method as claimed in claim 3, wherein the power and/or rotational speed reserve value (PnR) corresponds to:

(i) (maximum value (P4maxe) at the set rotational speed value (n4*e*)−required value (P4B))/the maximum value (P4maxe) at the set rotational speed value (n4*e*), and/or (ii) (set rotational speed value (n4*e*)−the rotational speed value (n4max) for a maximum value (P4max) equal to the required value (P4B))/the set rotational speed value (n4*e*), and the reserve limit value (PnRG) corresponds to:

at least 2%, or at least 5%, or at least 10%, and/or the further reserve limit value (PnRG') corresponds to:

at most 40%, or at most 30%, or at most 20%.

5. The method as claimed in claim 3, further comprising the step of:

ascertaining a present maximum value (P4maxact) at a present rotational speed value (n4act), and wherein step b) comprises:

ascertaining a present comparison variable value (P4B/P4maxact), in a form of a present power and/or rotational speed reserve value, on the basis of the present maximum value (P4maxact) and the required value (P4B), and comparing the present comparison variable value (P4B/P4maxact) with a comparison variable limit value (P4B/P4maxactG) at least associated with the reserve limit value (PnRG), and a further comparison variable limit value (P4B/P4maxactG') at least associated with the further reserve limit value (PnRG'), and setting the rotational speed value (n4*e*) in a manner dependent on the comparison.

6. The method as claimed in claim 5, wherein the construction-material and/or viscous-material pump has a control device, the control device being distinct from the motor system, and the method further comprising the steps of:

ascertaining the required value (P4B), and the present comparison variable value (P4B/P4maxact), and/or setting the rotational speed value (n4*e*) by way of the motor system, and ascertaining a setting command (n4*e*B), by comparing the present comparison variable value (P4B/P4maxact) with the comparison variable limit value (P4B/P4maxactG), in order to set the rotational speed value (n4*e*) by way of the control device.

7. The method as claimed in claim 1, wherein step a) comprises:

ascertaining the required value (P4B) on the basis of at least one part variable (G6) of a part of the construction-material and/or viscous-material pump, the part being distinct from the motor system.

8. The method as claimed in claim 7, wherein at least one of:

(i) the construction-material and/or viscous-material pump has a hydraulic drive system, the motor system being designed to move the hydraulic drive system, and a drive piston and a piston rod, of the hydraulic drive system, being designed to move the conveying piston, and the part variable (G6) being a drive variable (G7) of the hydraulic drive system, (ii) the part variable (G6) is a conveying variable (G3) of the conveying piston, or (iii) the construction-material and/or viscous-material pump has an adjustable line switch system, and the part variable (G6) being a switch variable (G10) of the adjustable line switch system.

9. The method as claimed in claim 8, wherein at least one of:

(i) the drive variable (G7) and/or the conveying variable (G3) is a stroke duration (HZD) and/or a speed (v) of the drive piston, of the piston rod and/or of the conveying piston, (ii) the drive variable (G7) is a drive volume flow (Q7), and/or the conveying variable (G3) is a conveying volume flow (Q3), (iii) the drive variable (G7) is a drive pressure (p7), and/or the conveying variable being a conveying pressure prevailing when the construction material and/or viscous material (BDS) is being conveyed, or (iv) the switch variable (G10) is an adjustment duration (VZD) of the adjustable line switch system.

10. The method as claimed in claim 1, wherein the required value (P4B) is a demanded power (P4act), or a variable of the motor system that corresponds to the demanded power, for moving the conveying piston.

11. The method as claimed in claim 1, further comprising the step of:

ascertaining the characteristic curve (KL) by interpolation based on interpolation points (SP), the interpolation points (SP) being defined by the maximum values (P4max) and the rotational speed values (n4).

12. The method as claimed in claim 1, wherein steps a) and b) are repeated multiple times during a stroke movement of the conveying piston in the conveying cylinder.

13. The method as claimed in claim 1, wherein step a) comprises:

ascertaining the required value (P4B) for at least one position (POa, POb), in a form of a middle position (POM), of the conveying piston along its stroke (HU) in the conveying cylinder between its end positions (POE), remote from the end positions (POE).

14. The method as claimed in claim 1, wherein the construction-material and/or viscous-material pump has a hydraulic drive system, the hydraulic drive system has an axial piston pump with variably adjustable swashplate, the motor system is designed to rotate the axial piston pump, and the axial piston pump is designed to move the conveying piston.

15. A construction-material and/or viscous-material pump for conveying construction material and/or viscous material, comprising:

at least one conveying cylinder, the conveying cylinder being designed to receive and discharge the construction material and/or viscous material;

at least one conveying piston, the conveying piston being arranged movably in the conveying cylinder in order to take in the construction material and/or viscous material into the conveying cylinder and in order to displace the taken-in construction material and/or viscous material out of the conveying cylinder; and a motor system, the motor system being designed to move the conveying piston; and a controller configured to:

ascertain a required value (P4B) of a power, or of a variable of the motor system that corresponds to the power, for moving the conveying piston, and depending on the required value (P4B), set a rotational speed value (n4*e*) of the motor system such that a power and/or rotational speed reserve value (PnR) between an operating point (BP) and a characteristic curve (KL) of the motor system is equal to or greater than a reserve limit value (PnRG), wherein the operating point (BP) is defined by the required value (P4B) of the power (P4) or of the variable and the rotational speed value (n4*e*), the characteristic curve (KL) is defined by maximum values (P4max) of the power (P4) or of the variable and rotational speed values (n4), the maximum values (P4max) differing at least partially for different rotational speed values (n4).

* * * * *